US011772154B1

(12) United States Patent
Wang et al.

(10) Patent No.: US 11,772,154 B1
(45) Date of Patent: Oct. 3, 2023

(54) PLUNGER FOR DIE CASTING AND METHOD OF MAKING THE SAME

(71) Applicants: GM GLOBAL TECHNOLOGY OPERATIONS LLC, Detroit, MI (US); Easyforming Steel Technology Co., Ltd., Chongqing (CN)

(72) Inventors: Zhou Wang, Shanghai (CN); Hongliang Yi, Suzhou (CN); Jianfeng Wang, Nanjing (CN); Lianqian Liu, Shenyang (CN)

(73) Assignees: GM GLOBAL TECHNOLOGY OPERATIONS LLC, Detroit, MI (US); EASYFORMING STEEL TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/950,723

(22) Filed: Sep. 22, 2022

(51) Int. Cl.

| | |
|---|---|
| ***B22D 17/20*** | (2006.01) |
| ***B22D 17/04*** | (2006.01) |
| ***C22C 38/58*** | (2006.01) |
| ***C22C 38/48*** | (2006.01) |
| ***C21D 6/00*** | (2006.01) |

(Continued)

(52) U.S. Cl.
CPC ..... *B22D 17/203* (2013.01); *B22D 17/04* (2013.01); *C21D 6/004* (2013.01); *C21D 6/005* (2013.01); *C22C 38/06* (2013.01); *C22C 38/42* (2013.01); *C22C 38/44* (2013.01); *C22C 38/48* (2013.01); *C22C 38/58* (2013.01)

(58) Field of Classification Search
CPC ..... B22D 17/203; B22D 17/04
See application file for complete search history.

(56) References Cited

U.S. PATENT DOCUMENTS

2011/0274946 A1* 11/2011 Severing ..... C21D 9/38 164/113
2022/0162731 A1 5/2022 Yi et al.

FOREIGN PATENT DOCUMENTS

EP 3926065 A1 12/2021

OTHER PUBLICATIONS

First Office Action for German Patent Application No. 10 2022 120 828.1 dated Jun. 27, 2023, with correspondence from Manitz Finsterwald Patent—und Rechtsanwaltspartnerschaft mbB summarizing Office Action; 4 pages.

* cited by examiner

*Primary Examiner* — Kevin P Kerns
*Assistant Examiner* — Steven S Ha
(74) *Attorney, Agent, or Firm* — Harness, Dickey & Pierce, P.L.C.

(57) ABSTRACT

A plunger for die casting may include a front injector end made of an iron alloy including, by mass: about 1% to about 6% nickel, about 0.1% to about 5% copper, about 0.2% to about 2.5% aluminum, about 0.5% to about 2% manganese, and about 0.05% to about 0.2% carbon. The iron alloy may be formed into an initial shape of the front injector end, heated to a temperature greater than or equal to about 900° C. and then cooled to form a supersaturated solid solution of iron and dissolved alloying elements. Then, the iron alloy may be heated at a temperature sufficient to precipitate intermetallic nanoparticles from the supersaturated solid solution to form an intermetallic precipitate phase dispersed throughout an iron-based matrix phase. A chemical compound layer may be formed at and along a surface of the iron alloy by exposing the iron alloy to an oxygen-containing and/or nitrogen-containing environment.

20 Claims, 4 Drawing Sheets

(51) Int. Cl.

| | |
|---|---|
| ***C22C 38/42*** | (2006.01) |
| ***C22C 38/06*** | (2006.01) |
| ***C22C 38/44*** | (2006.01) |

PLUNGER FOR DIE CASTING AND METHOD OF MAKING THE SAME

CROSS-REFERENCE TO RELATED APPLICATIONS

This application claims the benefit of Chinese Patent Application No. 202210883904.8 filed on Jul. 26, 2022. The entire disclosure of the application referenced above is incorporated herein by reference.

INTRODUCTION

This section provides background information related to the present disclosure which is not necessarily prior art.

The present disclosure generally relates to die casting tools and, more particularly, to iron-based alloy compositions and methods of manufacturing die casting tools therefrom.

Non-ferrous metals and metal alloys used in the manufacture of consumer products and component parts may be formed into desired shapes via die casting processes. In die casting, a volume of molten nonferrous metal referred to as "shot" is forced through a cylinder into a mold cavity via a plunger. The molten metal is allowed to cool and solidify within the mold cavity prior to removal of the cast part therefrom. In some casting processes (e.g., high pressure die casting processes), molten metal is forced into the mold cavity under high gauge pressure (e.g., at pressures of about 1,500 psi to about 25,400 psi), which may facilitate fast filling of the mold cavity and may allow for high volume production of parts having relatively thin walls (e.g., less than about 5 millimeters). Examples of nonferrous metals that may be manufactured via die casting processes include aluminum, magnesium, zinc, copper, and alloys thereof.

The components or tools of die casting machines that come into direct contact with molten nonferrous metal during the manufacturing process are oftentimes made of steel that is formulated and heat treated to exhibit certain desirable properties at high temperatures (e.g., about 500-700° C.), including high strength, wear resistance, impact toughness, thermal conductivity, and resistance to soldering. For example, hot-work tool steels used in the manufacture of die casting tools oftentimes include, by mass, about 0.4% carbon (C) to promote the formation of a hard martensitic microstructure during austenitizing and about 4-5% chromium (Cr) to provide the steels with high oxidation resistance. In addition, hot-work tool steels may include alloying elements of chromium (Cr), molybdenum (Mo), tungsten (W), vanadium (V), and/or manganese (Mn) to promote the formation of carbide particles within the martensitic microstructure during tempering to increase the hardness and strength of the steel. One example of a hot-work tool steel is H13, which comprises, by mass, about 4.75-5.5% Cr, 1.1-1.75% Mo, 0.8-1.2% Si, 0.8-1.2% V, 0.32-0.45% C, 0.3% Ni, 0.25% Cu, and 0.2-0.5% Mn. The H13 hot-work tool steel has a thermal conductivity of about 28.6 W/m·K at about 215° C. and a Rockwell hardness of about 38-53 HRC, depending upon the conditions of subsequent tempering heat treatments.

After steel die casting tools are initially formed, the tools are oftentimes subjected to various heat treatments to achieve a desired combination of mechanical properties. For example, after initial formation, steel die casting tools are oftentimes subjected to an annealing treatment at a temperature of about 870° C. to soften the steel prior to machining and produce a uniform microstructure, a stress relieving heat treatment at a temperature of about 600-650° C. (either before or after machining) to minimize distortion, an austenitizing heat treatment at a temperature of about 1010-1100° C. followed by quenching to a temperature of about 160° C. or below to obtain a martensitic microstructure and increase hardness, and two or three subsequent tempering heat treatments performed at temperatures of about 555-620° C. to increase impact toughness and ductility and decrease brittleness. In hot-work tool steels comprising greater than, by mass, about 0.3% C, the austenitizing and quenching heat treatment results in a substantial increase in the hardness of the steel, and thus machining operations generally must be carried out before austenitizing while the steel is relatively soft.

During an austenitizing heat treatment, steel die casting tools are heated above their upper austenite transformation temperature (Ac3) to transform the steel from a body-centered cubic (BCC) crystal structure known as ferrite to a face-centered cubic (FCC) crystal structure known as austenite. Alloying elements including carbon are considerably more soluble in austenite than in ferrite and, once the steel is heated above its upper austenite transformation temperature, alloying elements in the steel composition dissolve into the austenite crystal matrix, forming a solid solution of iron and alloying elements. Thereafter, when the steel is rapidly quenched, the alloying elements do not have enough time to diffuse out of the austenite crystal lattice before the temperature of the steel falls below a transformation temperature known as the martensite start temperature (Ms). As such, after the steel is cooled to a temperature below the martensite start temperature, the steel transforms into a supersaturated solid solution having a highly disordered body centered tetragonal (BCT) crystal structure known as martensite. After the steel is cooled to room temperature, carbon and other alloying elements trapped interstitially or substitutionally in the martensite crystal lattice function to resist slip dislocations within the crystal lattice, which effectively increases the strength and hardness of the steel.

A casting defect known as soldering may occur during die casting of nonferrous metals when molten nonferrous metal adheres or solders to surfaces of the steel die casting tools, including surfaces of the mold cavity, plunger, and/or ejector pins. Without intending to be bound by theory, it is believed that soldering may occur during casting due to chemical reactions, mechanical interactions, diffusion, and/or an atomic affinity between the steel of the die casting tools and the molten nonferrous metal, which may result in the formation of a strong bond therebetween. In some instances, chemical reactions between the steel of the die casting tools and the molten nonferrous metal may result in the formation of intermetallic layers along the interface between the surface of the die casting tools and the molten nonferrous metal. Nonferrous metal that adheres to the surface of a die casting tool may alter the shape of the surface of the die casting tool and damage may result during removal of solidified nonferrous metal from the surface of the die casting tool. For example, nonferrous metal that adheres to the surface of the mold cavity may cause the cast part to stick to the surface of the mold cavity when the cast part is ejected from the die, which may damage or remove material from the surface of the mold cavity. In addition, due to the relatively high temperature of the plunger, as compared to that of the mold cavity, soldering of nonferrous metal to the surface of the plunger may be greater than that experienced by the mold cavity. Indeed, soldering is a major failure mode for plunger tips of die casting machines.

It is believed that soldering may be prevented or inhibited by maintaining the steel die casting tools at a relatively low temperature, as compared to the temperature of the molten nonferrous metal. For example, the plunger used to inject the molten metal into the die cavity may include an internal cooling channel and a coolant may be circulated through the internal cooling channel to help maintain the plunger at a relatively low temperature during the die casting process and thereby prevent or inhibit molten nonferrous metal from adhering or soldering to a front injector end of the plunger. Due to the low thermal conductivity of hot-work tool steels, e.g., H13, used to manufacture plungers of die casting machines, it is generally desirable to continuously supply coolant to the plungers at a temperature of less than about 10° C. to effectively cool the plunger and suppress soldering.

SUMMARY

This section provides a general summary of the disclosure and is not a comprehensive disclosure of its full scope or all of its features.

The present disclosure relates to a plunger for die casting. The plunger comprises a front injector end including a front wall, a cylindrical sidewall extending from the front wall, and an outer peripheral surface at least partially defined by a front face of the front wall and an outer circumferential surface of the cylindrical sidewall. The front injector end is made of an iron alloy comprising, by mass: nickel in an amount greater than or equal to about 1% to less than or equal to about 6%, copper in an amount greater than or equal to about 0.1% to less than or equal to about 5%, aluminum in an amount greater than or equal to about 0.2% to less than or equal to about 2.5%, manganese in an amount greater than or equal to about 0.5% to less than or equal to about 2%, carbon in an amount greater than or equal to about 0.05% to less than or equal to about 0.2%; and greater than or equal to about 78% iron. A chemical compound layer is disposed at and along the outer peripheral surface of the front injector end. The chemical compound layer comprises a relatively high concentration of at least one of metal oxides, metal nitrides, and metal oxynitrides, as compared to a bulk volume of the front injector end. The chemical compound layer has a thickness extending from the outer peripheral surface of the front injector end of greater than or equal to about 2 micrometers to less than or equal to about 15 micrometers.

In some aspects, the chemical compound layer may comprise an oxide layer disposed at and along the outer peripheral surface of the front injector end. The oxide layer may comprise, by mass, $Fe_2O_3$ and/or $Fe_3O_4$ in an amount greater than or equal to about 90% of the oxide layer. The oxide layer may have a thickness of greater than or equal to about 2 micrometers to less than or equal to about 15 micrometers.

The oxide layer may comprise, by mass, chromium oxide and/or silicon oxide in an amount less than or equal to about 0.1% of the oxide layer.

In some aspects, the chemical compound layer may comprise an oxide layer and a nitride layer extending underneath the oxide layer at and along the outer peripheral surface of the front injector end. The oxide layer may comprise, by mass, $Fe_2O_3$ and/or $Fe_3O_4$ in an amount greater than or equal to about 5% of the oxide layer. The nitride layer may comprise, by mass, iron nitride in an amount greater than or equal to about 90% of the nitride layer and aluminum nitride in an amount greater than or equal to about 0.5% to less than or equal to about 2.5% of the nitride layer.

The plunger may further comprise a diffusion layer extending underneath the nitride layer at and along the outer peripheral surface of the front injector end. The diffusion layer may comprise, by mass, aluminum nitride in an amount greater than or equal to about 0.01% to less than or equal to about 2.5% of the diffusion layer and iron nitride in an amount greater than or equal to about 0.01% of the diffusion layer.

The iron alloy may have a microstructure that comprises an iron-based matrix phase and an intermetallic precipitate phase distributed throughout the iron-based matrix phase. The iron-based matrix phase may comprise at least one of martensite, bainite, and ferrite. The iron-based matrix phase may comprise, by volume, less than 5% austenite.

The inorganic precipitate phase may comprise intermetallic nanoparticles having a mean particle diameter of less than or equal to about 50 nanometers. Each of the intermetallic nanoparticles may comprise nickel, aluminum, copper, or a combination thereof.

A distribution density of the intermetallic nanoparticles in the iron-based matrix phase may be greater than or equal to about $10^{24}$ intermetallic nanoparticles per cubic meter.

The microstructure of the iron alloy may further comprise a metal carbide precipitate phase distributed throughout the iron-based matrix phase. The metal carbide precipitate phase may comprise metal carbide particles having particle diameters less than about 250 nanometers.

The iron alloy may exhibit a Rockwell hardness of greater than or equal to about 42 HRC at a temperature of about 25° C. The iron alloy may exhibits a thermal conductivity of greater than or equal to about 35 W/m·K at a temperature of greater than or equal to about 200° C. to less than or equal to about 500° C.

A method of manufacturing a plunger for die casting is disclosed. The method comprising the following steps in the sequence set forth. In a first step, an iron alloy is formed into an initial shape of a front injector end for a plunger of a die casting machine. The iron alloy comprises, by mass: nickel in an amount greater than or equal to about 1% to less than or equal to about 6%, copper in an amount greater than or equal to about 0.1% to less than or equal to about 5%, aluminum in an amount greater than or equal to about 0.2% to less than or equal to about 2.5%, manganese in an amount greater than or equal to about 0.5% to less than or equal to about 2%, carbon in an amount greater than or equal to about 0.05% to less than or equal to about 0.2%, and greater than or equal to about 78% iron. In a second step, the iron alloy is heated to a temperature greater than or equal to about 900° C. to form a solid solution of iron and dissolved alloying elements. In a third step, the iron alloy is cooled at a cooling rate of greater than or equal to about 5° C. per second to form a supersaturated solid solution of iron and dissolved alloying elements. In a fourth step, the iron alloy is heated at a temperature sufficient to precipitate intermetallic nanoparticles from the supersaturated solid solution to form an intermetallic precipitate phase dispersed throughout an iron-based matrix phase. In a fifth step, the iron alloy is exposed to an oxygen-containing environment and/or a nitrogen-containing environment to form a chemical compound layer disposed at and along the outer peripheral surface of the front injector end. The chemical compound layer comprises a relatively high concentration of at least one of metal oxides, metal nitrides, and metal oxynitrides, as compared to a bulk volume of the front injector end. Steps four and five are performed substantially simultaneously The iron alloy may be heated in steps four and five at a temperature of greater than or equal to about 350° C. to less than or equal to about 600° C.

In some aspects, the iron alloy may be exposed to an oxygen-containing environment in step five to form an oxide layer at and along the outer peripheral surface of the front injector end. The oxide layer may comprise, by mass, $Fe_2O_3$ and/or $Fe_3O_4$ in an amount greater than or equal to about 90% of the oxide layer. The oxide layer may have a thickness of greater than or equal to about 2 micrometers to less than or equal to about 15 micrometers.

In other aspects, the iron alloy may be exposed to an oxygen-containing environment and a nitrogen-containing environment in step five to form an oxide layer, a nitride layer extending underneath the oxide layer, and a diffusion layer extending underneath the nitride layer along the outer peripheral surface of the front injector end. The oxide layer may comprise, by mass, $Fe_2O_3$ and/or $Fe_3O_4$ in an amount greater than or equal to about 5% of the oxide layer. The nitride layer may comprise, by mass, iron nitride in an amount greater than or equal to about 90% of the nitride layer and aluminum nitride in an amount greater than or equal to about 0.5% to less than or equal to about 2.5% of the nitride layer.

In some aspects, the iron alloy may be exposed to the nitrogen-containing environment and then subsequently exposed to the oxygen-containing environment in step five.

In other aspects, the iron alloy may be simultaneously exposed to the oxygen-containing environment and the nitrogen-containing environment in step five.

The iron alloy may be simultaneously exposed to the oxygen-containing environment and the nitrogen-containing environment in step five by immersing the iron alloy in a liquid salt bath.

After step three and prior to step four, the iron alloy may have a Rockwell hardness of less than or equal to about 38 HRC at a temperature of about 25° C. After step four, the iron alloy may have a Rockwell hardness of greater than or equal to about 42 HRC at a temperature of about 25° C. and a thermal conductivity of greater than or equal to about 35 W/m·K at a temperature of greater than or equal to about 200° C. to less than or equal to about 500° C.

The method may further comprise, after step three and prior to step four, machining the iron alloy to a final shape of the front injector end.

The iron alloy may not be subjected to an annealing heat treatment or a stress relief heat treatment prior to step two. The iron alloy may not be subjected to a tempering heat treatment after step three.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
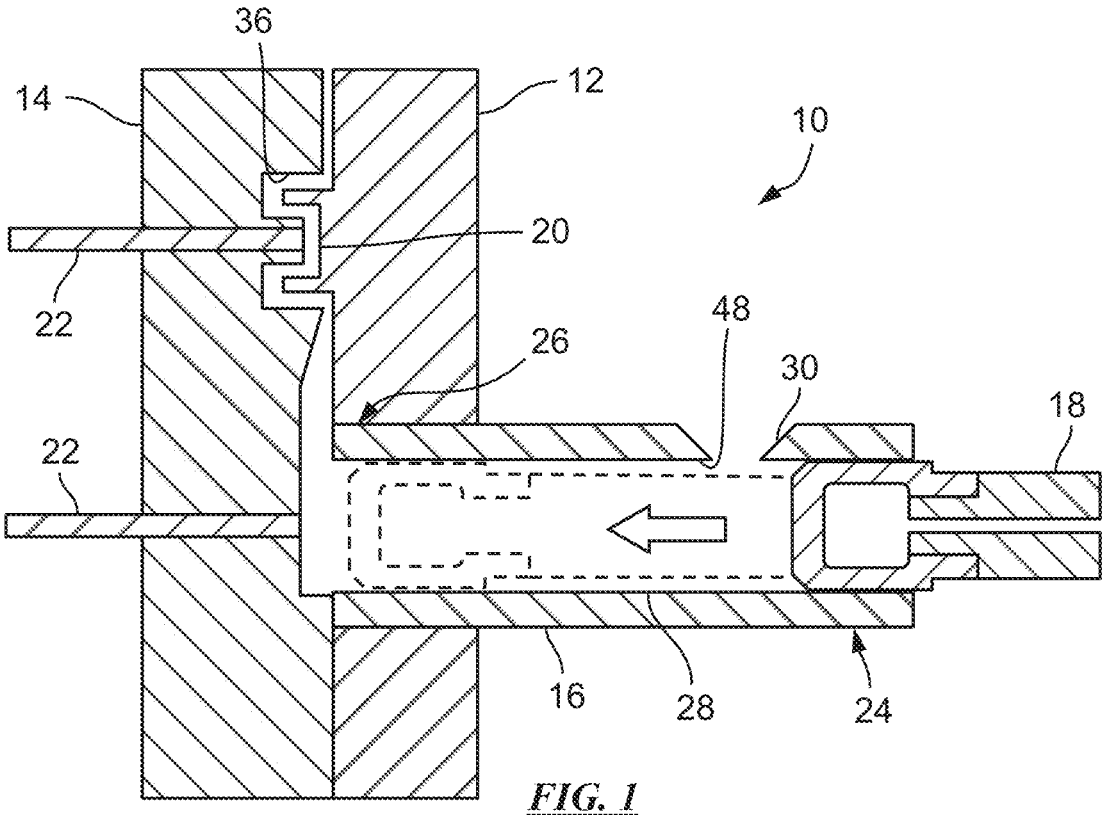
FIG. 1 is a schematic cross-sectional view of a cold chamber die casting machine, including a pair of die halves at least partially defining a die cavity, a cylindrical sleeve, and a plunger configured to push a volume of molten nonferrous metal through a horizontal passageway defined by the sleeve and into the die cavity.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended terms "comprises," "comprising," "including," and "having," are to be understood as non-restrictive terms used to describe and claim various embodiments set forth herein, in certain aspects, the terms may alternatively be understood to instead be a more limiting and restrictive term, such as "consisting of" or "consisting essentially of" Thus, for any given embodiment reciting compositions, materials, components, elements, ingredients, features, integers, operations, and/or process steps, the present disclosure also specifically includes embodiments consisting of, or consisting essentially of, such recited compositions, materials, components, elements, ingredients, features, integers, operations, and/or process steps. In the case of "consisting of," the alternative embodiment excludes any additional compositions, materials, components, elements, ingredients, features, integers, operations, and/or process steps, while in the case of "consisting essentially of," any additional compositions, materials, components, elements, ingredients, features, integers, operations, and/or process steps that materially affect the basic and novel characteristics are excluded from such an embodiment, but any compositions, materials, components, elements, ingredients, features, integers, operations, and/or process steps that do not materially affect the basic and novel characteristics can be included in the embodiment.

Any method steps, processes, and operations described herein are not to be construed as necessarily requiring their performance in the order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer, or section. Terms such as "first," "second," and other numerical terms when used herein do not imply a sequence or order unless clearly indicated by the context. Thus, a first step, element, component, region, layer, or section discussed below could be termed a second step, element, component, region, layer, or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s), as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges and encompass minor deviations from the given values and embodiments, having about the value mentioned as well as those having exactly the value mentioned. Other than the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

As used herein, the terms "composition" and "material" are used interchangeably to refer broadly to a substance containing at least the preferred chemical constituents, elements, or compounds, but which may also comprise additional elements, compounds, or substances, including trace amounts of impurities, unless otherwise indicated. An "X-based" composition or material broadly refers to compositions or materials in which "X" is the single largest constituent of the composition or material on a weight percentage (%) basis. This may include compositions or materials having, by weight, greater than 50% X, as well as those having, by weight, less than 50% X, so long as X is the single largest constituent of the composition or material based upon its overall weight.

As used herein, the term "metal" may refer to a pure elemental metal or to an alloy of an elemental metal and one or more other metal or nonmetal elements.

As used herein, the term "iron alloy" refers to a material that comprises, by mass, greater than or equal to about 78% or greater than or equal to about 80% iron (Fe) and one or more other elements (referred to as "alloying" elements) selected to impart certain desirable properties to the material that are not exhibited by pure iron.

Example embodiments will now be described more fully with reference to the accompanying drawings.

The presently disclosed die casting tools are made of an iron alloy that is formulated with a relatively low carbon content, i.e., less than or equal to about 0.2% by mass of the iron alloy. As such, the iron alloy does not exhibit substantial solid solution strengthening (i.e., high hardness and brittleness) when subjected to an austenitizing heat treatment followed by quenching. Instead, hardness and strength are developed in the iron alloy during a subsequent precipitation hardening or aging heat treatment in which intermetallic nanoparticles precipitate from a supersaturated solid solution to form an intermetallic precipitate phase dispersed throughout an iron-based matrix phase. The term "intermetallic," as used herein, refers to a material that consists of a combination of metal elements that may be chemically bonded together in the form of a chemical compound having a specific composition and an ordered crystallographic structure. As used herein, the term "intermetallic" specifically excludes materials that contain carbon, e.g., carbides.

Because the hardness and strength of the presently disclosed iron alloy may be attributed to the precipitation hardened microstructure of the iron alloy, instead of from interstitial or substitutional solid solution strengthening, the presently disclosed iron alloy may exhibit relatively high thermal conductivity, as compared to austenitized and quenched iron alloys with relatively high carbon contents.

Without intending to be bound by theory, it is believed that the relatively high thermal conductivity of the presently disclosed iron alloy may help reduce thermal gradients within die casting tools formed therefrom during die casting operations, which may help reduce thermal stress experienced by the die casting tools during repeated casting cycles. In addition, the relatively high thermal conductivity of the presently disclosed iron alloy may improve the heat transfer rate between die casting tools formed therefrom and a cooling medium during die casting operations, which may help maintain the die casting tools at a relatively low temperature, as compared to that of the molten nonferrous metal, which may inhibit chemical reactions between the iron alloy material of the die casting tools and the molten nonferrous metal, thereby increasing the soldering resistance of the die casting tools. In addition, because hardness and strength are developed in the presently disclosed iron alloy after a solution heat treatment, i.e., during a subsequent precipitation hardening or aging heat treatment, die casting tools made from the presently disclosed iron alloy may be machined to a final shape after the solution heat treatment without requiring the use of relatively expensive and/or time-consuming machining operations. Furthermore, because an austenitizing heat treatment followed by quenching is not required to develop hardness and strength in the presently disclosed iron alloys, die casting tools made therefrom may exhibit a desired microstructure and a desired combination of mechanical and chemical properties at high temperatures without having to be subjected to various annealing and/or stress relieving heat treatments prior to austenitizing and/or to repeated tempering heat treatments after austenitizing, which may increase the energy efficiency of the manufacturing process.

In some embodiments, precipitation hardening of die casting tools made from the presently disclosed iron alloy may be combined with or may inherently occur during a thermochemical surface treatment, e.g., an oxidizing, nitriding, or oxynitriding surface treatment. The thermochemical surface treatment may be performed at substantially the same temperatures and times as that of the precipitation hardening heat treatment, further increasing the energy efficiency of the manufacturing process. The nitriding and/or oxidation surface treatment may be performed such that metal nitrides, metal oxides, and/or metal oxynitrides form within a layer of material disposed at and along a surface of the die casting tool. Without intending to be bound by theory, it is believed that the formation of these metal nitrides, metal oxides, and/or metal oxynitrides may help prevent or inhibit chemical reactions from occurring along an interface between the surface of the die casting tool and the nonferrous metal of the cast part during casting, which may prevent or inhibit soldering between the die casting tool and the nonferrous metal of the cast part.

FIG. 1 depicts a die casting machine 10 for use in casting nonferrous metal parts using a cold chamber die casing process. The die casting machine 10 depicted in FIG. 1 may be used for casting shaped aluminum and/or magnesium parts. The presently disclosed iron alloy and die casting tools manufactured therefrom may be used in various die casting machines, including the die casting machine 10 depicted in FIG. 1, as well as in other die casting machines configured for casting shaped nonferrous metal parts. For example, the presently disclosed iron alloy and die casting tools manufactured therefrom may be used in cold chamber die casting machines, which may be used for casting shaped zinc and/or copper parts.

The die casting machine 10 includes a stationary die 12, an opposing moveable die 14, a substantially cylindrical sleeve 16, and a plunger 18 at least partially disposed within the sleeve 16. During a die casting process, the moveable die 14 is positioned adjacent the stationary die 12 and, together, the stationary die 12 and the opposing moveable die 14 define a mold cavity 20 therebetween. The die casting machine 10 optionally may include one or more ejector pins 22 for ejecting a cast part from the mold cavity 20. One or more cores (not shown) optionally may be positioned within the mold cavity 20 during the die casting process to help form a cast part having a desired shape.

The sleeve 16 is hollow and includes a receiving end 24, an opposite discharge end 26, and a passageway 28 extending in an axial direction therethrough, between the receiving end 24 and the discharge end 26. The receiving end 24 of the sleeve 16 may include an opening 30 in an upper side thereof through which a volume of molten metal can be received and introduced into the passageway 28. The discharge end 26 of the sleeve 16 is in communication with the mold cavity 20 and may extend at least part-way through the stationary die 12.

Figure 2:
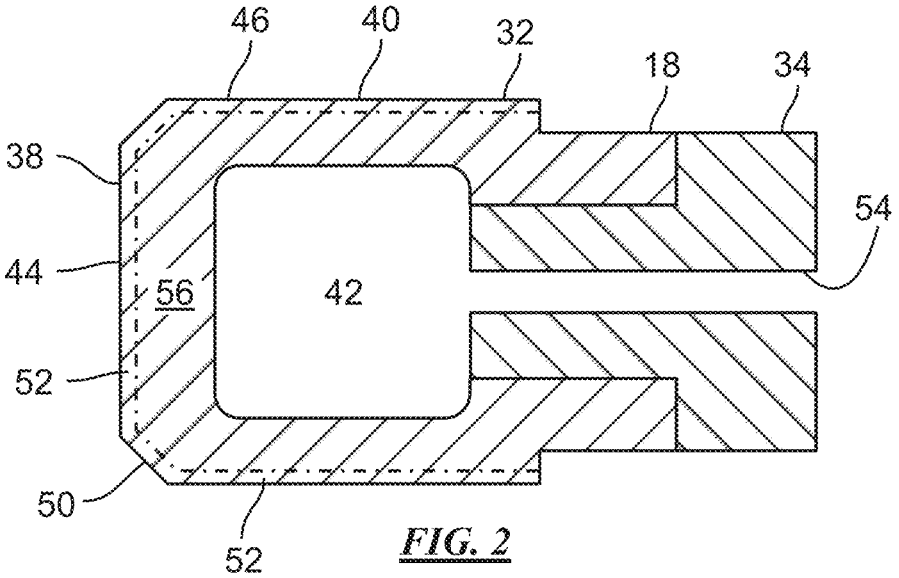
FIG. 2 is an enlarged view of a front injector end of the plunger of the die casting machine of FIG. 1.

The plunger 18 is configured to slide in an axial direction back-and-forth within the passageway 28 defined by the sleeve 16. During a die casting process, the plunger 18 is configured to push a volume of molten nonferrous metal through the passageway 28 and into the mold cavity 20. As best shown in FIG. 2, the plunger 18 includes a front injector end 32 and an elongated body 34 extending therefrom, away from the stationary die 12.

The front injector end 32 includes a front wall 38, a cylindrical sidewall 40 extending from the front wall 38, and an optional cooling chamber 42 defined within a central region of the front injector end 32. The front wall 38 may define a front face or surface 44 of the front injector end 32 that comes into direct contact with molten nonferrous metal during die casting. The cylindrical sidewall 40 may define an outer circumferential surface 46 of the front injector end 32 that slides against an inner surface 48 of the sleeve 16 during die casting. An outer peripheral surface 50 of the front injector end 32 may be at least partially defined by the front face 44 and the outer circumferential surface 46 of the front injector end 32.

A coolant may be supplied to and/or circulated through the cooling chamber 42 during die casting to help maintain the front injector end 32 at a relatively low temperature, as compared to the temperature of the molten nonferrous metal, which may help prevent soldering between the iron alloy material of the front injector end 32 and the molten nonferrous metal.

The elongated body 34 may couple the front injector end 32 of the plunger 18 to a mechanical device configured to control the back-and-forth movement of the front injector end 32 during die casting. The elongated body 34 may include a cooling channel 54 that extends in an axial direction through the elongated body 34 to the coolant chamber 42 so that coolant may be supplied to the coolant chamber 42 through the cooling channel 54 of the elongated body 34.

The front injector end 32 of the plunger 18 is made of an iron alloy comprising, in addition to iron, alloying elements of nickel (Ni), copper (Cu), aluminum (Al), manganese (Mn), and carbon (C), and thus may be referred to as an Fe—Ni—Cu—Al—Mn—C alloy. The presently disclosed iron alloy may be used to manufacture other tooling components of die casting machines. For example, the presently disclosed iron alloy may be used to manufacture surface portions of the stationary die 12 and/or the moveable die 14 that form an interior surface 36 of the mold cavity 20. The iron alloy is formulated to provide the front injector end 32 and other die casting tools made therefrom with a desired combination of chemical and mechanical properties at high temperatures (e.g., about 400-600° C.), including high strength, wear resistance, impact toughness, thermal conductivity, and resistance to soldering.

The amount of carbon in the iron alloy is selected to provide the iron alloy with the ability to undergo an austenitizing heat treatment or a solution heat treatment followed by quenching without developing a brittle martensite microstructure therein. The iron alloy may comprise, by mass, greater than or equal to about 0.05% carbon; less than or equal to about 0.2% or about 0.15% carbon; or between about 0.05% to about 0.2% or about 0.05% to about 0.15% carbon.

The total and respective amounts of Ni, Cu, and/or Al in the iron alloy are selected to provide the iron alloy with the ability to develop a precipitation hardened microstructure when subjected to a precipitation hardening or aging heat treatment. The iron alloy may comprise, by mass, greater than or equal to about 1% nickel; less than or equal to about 6% nickel; or between about 1% to about 6% nickel. The iron alloy may comprise, by mass, greater than or equal to about 0.1% copper; less than or equal to about 5% or about 2.5% copper; or between about 0.1% to about 5% or about 0.1% to about 2.5% copper. The iron alloy may comprise, by mass, greater than or equal to about 0.2% aluminum; less than or equal to about 2.5% or about 1.7% aluminum; or between about 0.2% to about 2.5% or about 0.2% to about 1.7% aluminum. A mass ratio of nickel to aluminum in the iron alloy may be greater than or equal to about 2 to less than or equal to about 5.

The amount of manganese included in the iron alloy may be selected to improve the hardenability of the iron alloy. The iron alloy may comprise, by mass, greater than or equal to about 0.5% manganese; less than or equal to about 2% or about 1.5% manganese; or between about 0.5% to about 2% or about 0.5% to about 1.5% manganese. A mass ratio of nickel to manganese in the iron alloy may be greater than or equal to about 1 to less than or equal to about 3.

The iron alloy optionally may comprise chromium (Cr). The amount of chromium included in the iron alloy may be selected to provide the iron alloy with corrosion resistance and to improve the hardenability of the iron alloy. The iron alloy may comprise, by mass, greater than or equal to about 0% chromium; less than or equal to about 2% or about 1.5% chromium; or between about 0% to about 2% or about 0% to about 1.5% chromium.

The iron alloy optionally may comprise molybdenum (Mo), tungsten (W), and/or niobium (Nb). The amount of molybdenum, tungsten, and/or niobium included in the iron alloy may be selected to provide the iron alloy with the ability to develop a carbide precipitate phase, which may increase the strength and hardness of die casting tools made therefrom. The iron alloy may comprise, by mass, greater than or equal to about 0% molybdenum; less than or equal to about 1.5% or about 1% molybdenum; or between about 0% to about 1.5% or about 0% to about 1% molybdenum. The iron alloy may comprise, by mass, greater than or equal to about 0% tungsten; less than or equal to about 2.5% or about 2% tungsten; or between about 0% to about 2.5% or about 0% to about 2% tungsten. The iron alloy may comprise, by mass, greater than or equal to about 0% niobium; less than or equal to about 0.2% niobium; or between about 0% to about 0.2% niobium.

The iron alloy may comprise, by mass, greater than or equal to about 78%, about 80%, or about 81% iron.

Additional elements not intentionally introduced into the composition of the presently disclosed iron alloy nonetheless may be inherently present in the alloy in relatively small amounts, for example, in individual and/or cumulative amounts, by mass, less than or equal to about 0.1%, optionally less than or equal to about 0.05%, optionally less than or equal to about 0.01%, or optionally less than or equal to about 0.001% of the iron alloy. Such elements may be present, for example, as impurities in the raw or scrap materials used to prepare the iron alloy. In embodiments where the iron alloy is referred to as comprising one or more alloying elements (e.g., one or more of Ni, Cu, Al, Mn, C, Cr, Mo, W, and/or Nb) and iron as balance, the term "as balance" does not exclude the presence of additional elements not intentionally introduced into the composition of the iron alloy but nonetheless inherently present in the alloy in relatively small amounts, e.g., as impurities.

In a method of manufacturing a tool for a die casting machine, such as the die casting machine 10 depicted in FIG. 1, a volume of the presently disclosed iron alloy may be formed into an initial shape of the die casting tool. For example, a volume of the presently disclosed iron alloy may be formed into an initial shape of the front injector end 32 of the plunger 18. As another example, a volume of the presently disclosed iron alloy may be formed into an initial shape of the stationary die 12, the moveable die 14, or an insert of the stationary die 12 and/or the moveable die 14 that defines the interior surface 36 of the mold cavity 20. As another example, a volume of the presently disclosed iron alloy may be formed into an initial shape of one of more of the ejector pins 22. The iron alloy may be formed into the initial shape of a die casting tool by various methods known in the art, including, for example, by forging and/or rolling.

Figure 3:
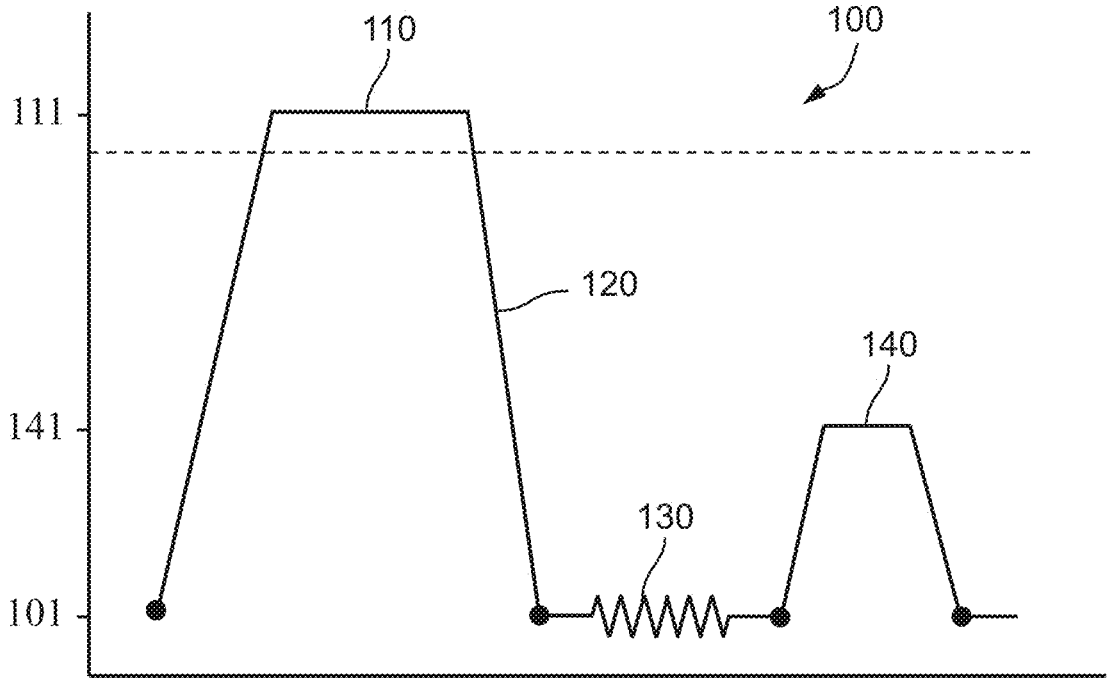
FIG. 3 depicts a time (hours) vs. temperature (° C.) diagram of a heat treatment cycle for developing a desired microstructure in a die casting tool made of an Fe—Ni—Cu—Al—Mn—C alloy.

FIG. 3 depicts a heat treatment cycle 100 that may be applied to the iron alloy to develop a desired microstructure therein. In addition, the heat treatment cycle 100 may be combined with a thermochemical surface treatment to form a relatively hard chemical compound layer at and along the outer peripheral surface 50 of the front injector end 32. As shown in FIG. 3, after the iron alloy is formed into the initial shape of a die casting tool, the iron alloy may be subjected to a solution heat treatment 110, followed by cooling 120, optional machining 130, and a precipitation hardening or aging heat treatment 140, which may be combined with a thermochemical surface treatment. In FIG. 3, the temperature 101 refers to ambient temperature, e.g., about 25° C. Because hardness and strength are developed in the presently disclosed iron alloy during the precipitation hardening heat treatment 140, it is not necessary to subject the iron alloy to an annealing heat treatment and/or a stress relieving heat treatment prior to the solution heat treatment 110, nor is it necessary to subject the iron alloy to a tempering heat treatment after the solution heat treatment 110.

During the solution heat treatment 110, the iron alloy is heated to a first temperature 111 for a sufficient duration to transform the microstructure of the iron alloy substantially completely to a single-phase solid solution and to dissolve the alloying elements into the single-phase solid solution. For example, the solution heat treatment 110 may include heating the iron alloy to a temperature greater than or equal to about 900° C. to less than or equal to about 1050° C. for greater than or equal to about 0.5 hours to less than or equal to about 24 hours or about 12 hours. In aspects, the solution heat treatment 110 may be performed at a temperature of about 950° C. for about 1 hour. In some embodiments, during the solution heat treatment 110, the iron alloy is heated to a first temperature 111 greater than or equal to an upper austenite transformation temperature (Ac3) of the iron alloy. In such case, during the solution heat treatment 110, the microstructure of the iron alloy may transform to a single-phase solid solution referred to as austenite and the alloying elements may dissolved into the austenite crystal matrix. The upper austenite transformation temperature of the iron alloy may be about 900° C.

After the solution heat treatment 110, the iron alloy is cooled 120 to ambient temperature 101. The iron alloy may be cooled, for example, in air from the first temperature 111 to ambient temperature 101 at a cooling rate of greater than or equal to about 5° C./second. In some aspects, the iron alloy may be cooled at a cooling rate of less than 30° C. per second, less than 20° C. per second, or less than 10° C. per second. In some embodiments, the iron alloy may be cooled relatively rapidly to a second temperature (not shown) less than a martensite start (Ms) temperature of the iron alloy to transform at least a portion of the austenite in the iron alloy to martensite, and then the iron alloy may be cooled to ambient temperature 101 at a relatively slow cooling rate. After the iron alloy is cooled 120 to ambient temperature 101, the iron alloy may be in the form of a supersaturated solid solution and may include a mixture of one or more phases of martensite, bainite, and ferrite, and less than, by volume, about 5% austenite.

After the solution heat treatment 110 and cooling 120, due to the relatively low amount of carbon in the iron alloy, the iron alloy may be relatively soft, as compared to iron alloys that comprise, by mass, greater than about 0.3% or about 0.4% carbon. For example, after the solution heat treatment 110 and cooling 120, the iron alloy may exhibit a Rockwell hardness of less than about 38 HRC, less than about 37 HRC, or less than about 36 HRC at a temperature of about 25° C. In one specific example, after the solution heat treatment 110 and cooling 120, the iron alloy may exhibit a Rockwell hardness of about 35 HRC.

After the solution heat treatment 110 and cooling 120, the iron alloy may be machined 130 or subjected to other surface treatments to form the iron alloy into a final shape of the die casting tool. In some embodiments, machining 130 may be necessary or desired to compensate for distortions in the physical shape of the die casting tool, which may occur during or after the solution heat treatment 110 and cooling 120 steps. Due to the relatively low amount of carbon in the presently disclosed iron alloy, however, machining 130 may be performed relatively easily due to the relative softness of the iron alloy and without requiring the use of relatively expensive machining equipment. Methods of machining 130 the iron alloy may include turning, milling, shaping, planning, drilling, electron beam machining, laser beam machining, and combinations thereof.

Figure 4:
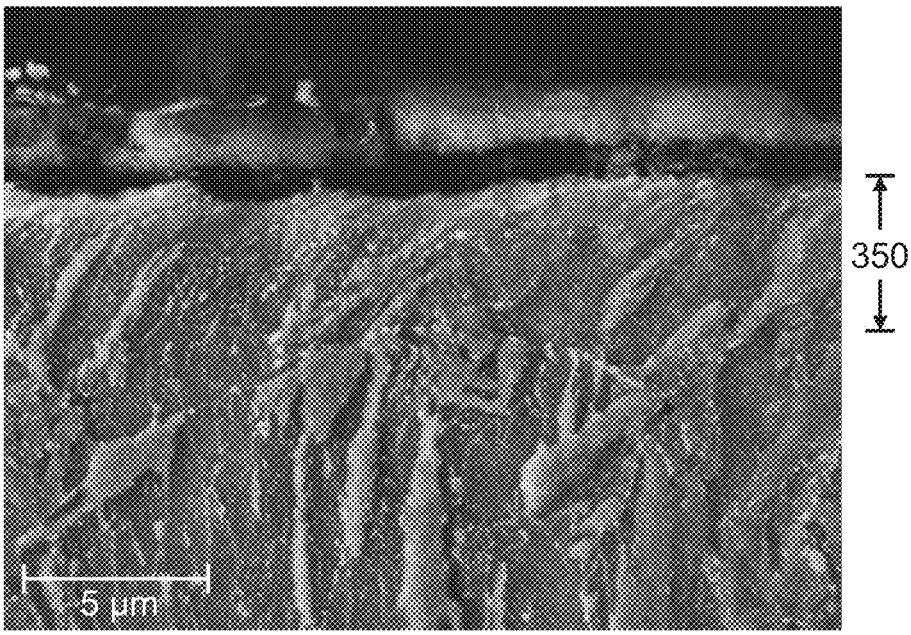
FIG. 4 is a scanning electron microscope (SEM) image of a surface of a die casting tool after the die casting tool has been machined to a final shape.

Referring now to FIG. 4, because the iron alloy is machined to a final shape of the die casting tool after the solution heat treatment 110 and cooling 120, physical changes in the microstructure of the die casting tool that may occur during machining 130 may be retained in the die casting tool and may be visible at high magnification along the outer peripheral surface of the die casting tool. For example, after machining 130, a deformed material layer 350 disposed along an outer peripheral surface of the die casting tool may exhibit a deformed microstructure indicative of a direction in which the machining 130 was performed. Additionally or alternatively, the deformed material layer 350 may exhibit deformed crystal grains and a refined grain microstructure. After machining 130, deformed material layer 350 disposed along the outer peripheral surface of the die casting tool may have a thickness of greater than or equal to about 1 micrometer to less than or equal to about 10 micrometers. Die casting tools that are machined to a final desired shape prior to being subjected to an austenitizing heat treatment following by quenching will not retain visible markings on their outer peripheral surfaces from the prior machining process.

After machining 130, the iron alloy is subjected to a precipitation hardening heat treatment 140 to increase the hardness of the iron alloy. During the precipitation hardening heat treatment 140, the iron alloy may be heated to a third temperature 141 greater than ambient temperature 101 and substantially less than the first temperature 111 (the temperature of the solution heat treatment 110). For example, the iron alloy may be heated during the precipitation hardening heat treatment 140 to a third temperature 141 greater than or equal to about 350° C., about 400° C., or about 425° C. and less than or equal to about 600° C. The precipitation hardening heat treatment 140 may be performed for a duration sufficient to cause intermetallic nanoparticles to precipitate from the supersaturated solid solution and form an intermetallic precipitate phase distributed throughout an iron-based matrix phase. For example, the precipitation hardening heat treatment 140 may be performed for a duration of greater than or equal to about 5 minutes, about 0.5 hours, or about 5 hours and less than or equal to about 50 hours, about 15 hours, or about 12 hours. In some aspects, the precipitation hardening heat treatment 140 may be performed at a temperature of about 450° C. for a duration of about 8-12 hours.

The intermetallic nanoparticles of the intermetallic precipitate phase may precipitate along defect dislocations within the crystal lattice structure of the iron-based matrix phase and may increase the hardness of the iron alloy by impeding the movement of the dislocations in the crystal lattice. For example, after the precipitation hardening heat treatment 140, the iron alloy may exhibit a hardness of greater than or equal to about 42 HRC at a temperature of about 25° C. For example, after the precipitation hardening heat treatment 140, the iron alloy may exhibit a hardness of about 49 HRC at a temperature of about 25° C.

It is believed that formation of the intermetallic precipitate phase within the iron-based matrix phase of the iron alloy may increase the hardness of the iron alloy while also increasing the thermal conductivity of the iron alloy. Without intending to be bound by theory, it is believed that the removal of alloying elements from the iron-based matrix phase due to the precipitation of intermetallic nanoparticles therefrom may effectively purify the composition of the iron-based matrix phase, improving the ability of electrons to move within the iron-based matrix phase and thereby improving the ability of the iron-based matrix phase to conduct heat. As such, in comparison to iron alloys that comprise, by mass, greater than about 0.3% or about 0.4% carbon and rely upon solid solution strengthening to impart hardness thereto, the presently disclosed precipitation hardened iron alloy may exhibit a relatively high thermal conductivity. For example, after the precipitation hardening heat treatment 140, the iron alloy may exhibit a thermal conductivity of greater than or equal to about 35 W/m·K in a temperature range of greater than or equal to about 200° C. to less than or equal to about 500° C. For example, after the precipitation hardening heat treatment 140, the iron alloy may exhibit a thermal conductivity of greater than or equal to about 37 W/m·K, about 38 W/m·K, or about 39 W/m·K in a temperature range of greater than or equal to about 250° C. to less than or equal to about 350° C.

Without intending to be bound by theory, it is believed that the relatively high thermal conductivity of the iron alloy after the precipitation hardening heat treatment 140 may help reduce thermal gradients within die casting tools made of the iron alloy, which may help reduce thermal stress within the die casting tools during repeated casting cycles, and thus may increase the life of die casting tools made form the iron alloy. In addition, the relatively high thermal conductivity of the iron alloy after the precipitation hardening heat treatment 140 may improve the heat transfer rate between die casting tools made of the iron alloy and the coolant used to cool the die casting tools during casting, which may help maintain the die casting tools at a relatively low temperature, as compared to that of the molten nonferrous metal. The occurrence of soldering between die casting tools and nonferrous metals is strongly correlated with temperature, with increases in the temperature of the die casting tools increasing the likelihood of chemical reactions between the iron alloy material of the die casting tools and the nonferrous metal of the cast parts. Therefore, the relatively high thermal conductivity of the iron alloy after the precipitation hardening heat treatment 140 may allow die casting tools made of the iron alloy to be maintained at a relatively low temperature during casting operations, as compared to tools with relatively low thermal conductivities, which may prevent or inhibit chemical reactions between the iron alloy material of the die casting tools and the nonferrous metal of the cast part, thereby preventing or inhibiting the occurrence of soldering. In addition, it is believed that the relatively high thermal conductivity of the presently disclosed iron alloy after the precipitation hardening heat treatment 140 may help reduce thermal gradients in the die casting tools during casting operations, which may, in turn, reduce physical distortions to the shape of the die casting tools over time.

After the precipitation hardening heat treatment 140, the intermetallic nanoparticles of the intermetallic precipitate phase may have a mean particle diameter of less than or equal to about 50 nanometers. A distribution density of the intermetallic nanoparticles in the iron-based matrix phase may be greater than or equal to about $10^{24}$ nanoparticles per cubic meter. The intermetallic precipitate phase may comprise intermetallic nanoparticles of nickel, aluminum, and/or copper. For example, the intermetallic nanoparticles may comprise or consist essentially of nickel-, aluminum-, and copper-containing particles (Ni—Al—Cu nanoparticles). As another example, the intermetallic nanoparticles may comprise or consist essentially of nickel- and aluminum-containing particles (Ni—Al nanoparticles). In another example, the intermetallic nanoparticles may comprise or consist essentially of copper-containing particles (Cu nanoparticles). During precipitation of the intermetallic precipitate phase from the iron-based matrix phase, the nickel, aluminum, and/or copper may coprecipitate such that each of the intermetallic nanoparticles comprise co-precipitated amounts of nickel, aluminum, and/or copper. After the precipitation hardening heat treatment 140, the intermetallic precipitate phase may account for, by mass, greater than or equal to about 1% or about 2% to less than or equal to about 12% of the iron alloy.

In some embodiments, during the precipitation hardening heat treatment 140, metal carbide particles may precipitate from the supersaturated solid solution to form a metal carbide precipitate phase distributed throughout the iron-based matrix phase. The metal carbide precipitate phase may comprise or consists essentially of metal carbides, e.g., carbides of chromium, tungsten, molybdenum, and/or niobium. The metal carbide particles of the metal carbide precipitate phase may have particle diameters of less than about 250 nanometers. When present, the metal carbide precipitate phase may account for, by mass, greater than or equal to about 0% to less than or equal to about 3% of the iron alloy.

Figure 5:
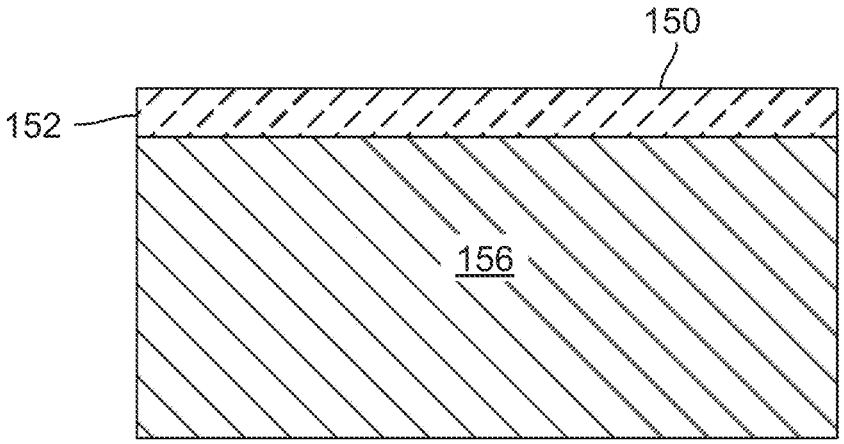
FIG. 5 is a schematic cross-sectional view of a surface of a die casting tool made of an Fe—Ni—Cu—Al—Mn—C alloy and having an oxide layer formed at and along the surface of the die casting tool.
Figure 6:
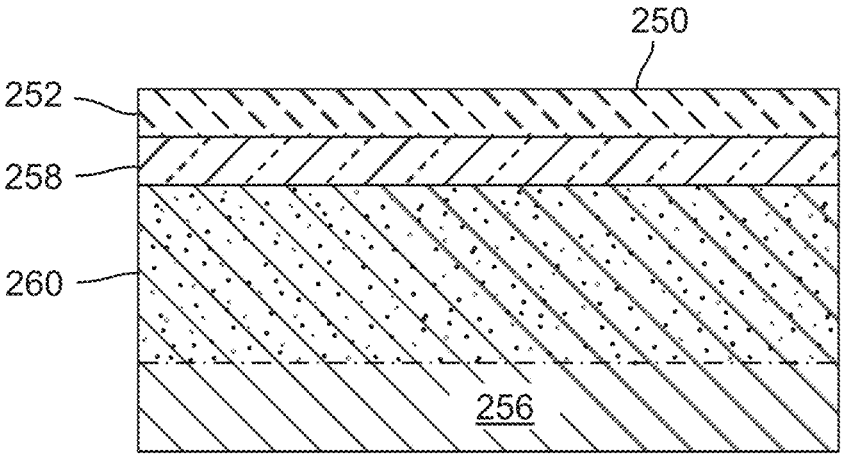
FIG. 6 is a schematic cross-sectional view of a surface of a die casting tool made of an Fe—Ni—Cu—Al—Mn—C alloy and having an oxide layer, a nitride layer, and a diffusion layer formed at and along the surface of the die casting tool.

Referring now to FIGS. 2, 5, and 6, in some embodiments, the precipitation hardening heat treatment 140 may be combined with a thermochemical surface treatment to form a chemical compound layer at and along a surface of the die casting tool. For example, as shown in FIG. 2, in some embodiments, the precipitation hardening heat treatment 140 may be combined with a thermochemical surface treatment to form a chemical compound layer 52 at and along the outer peripheral surface 50 of the of the front injector end 32. As another example, the precipitation hardening heat treatment 140 may be combined with a thermochemical surface treatment to form a chemical compound layer at and along the interior surface 36 of the mold cavity 20. The thermochemical surface treatment may be performed at the same temperatures and for the same durations as that of the precipitation hardening heat treatment 140. As such, the precipitation hardening heat treatment 140 may be performed simultaneously or may inherently occur during the thermochemical surface treatment.

In the presently disclosed iron alloy, hardness and strength are developed in the iron alloy during the precipitation hardening heat treatment 140, and not during an austenitizing and quenching heat treatment process, which is oftentimes used to increase the hardness and strength of iron alloys having relatively high carbon contents. As such, the presently disclosed iron alloy does not need to be subjected to repeated tempering heat treatments, which are oftentimes required after austenitizing and quenching iron alloys having relatively high carbon contents. In addition, the precipitation hardening heat treatment 140 may be performed at substantially the same temperatures and for substantially the same durations as that of certain thermochemical surface treatments disclosed herein, e.g., oxidizing, nitriding, and/or oxynitriding treatments. As such, the precipitation hardening heat treatment 140 and the thermochemical surface treatment(s) may be combined and performed at substantially the same time during manufacture of die casting tools. However, unlike the temperatures and durations of the precipitation hardening heat treatment 140, the temperatures and durations of tempering heat treatments performed after austenitizing and quenching iron alloys having relatively high carbon contents are not substantially the same as the temperatures and durations of the presently disclosed thermochemical surface treatment(s). To be sure, the temperatures of the tempering heat treatments performed after austenitizing and quenching are generally much higher than the temperatures used during the presently disclosed thermochemical surface treatment(s). For example, tempering heat treatments performed after austenitizing and quenching are typically performed at temperatures of greater than about 550° C. or about 600° C. Therefore, the presently disclosed thermochemical surface treatment(s), e.g., oxidizing, nitriding, and/or oxynitriding treatments, may not be combined or performed at substantially the same time as the tempering heat treatments performed after austenitizing and quenching iron alloys having relatively high carbon contents. Generally, if an oxidizing, nitriding, and/or oxynitriding treatment is to be performed on an iron alloy having relatively high carbon content, the oxidizing, nitriding, and/or oxynitriding treatment is performed after austenitizing and quenching, and after all tempering heat treatments have been performed.

The thermochemical surface treatment may comprise an oxidizing treatment in which the iron alloy is heated in an oxygen-containing environment, a nitriding treatment in which the iron alloy is heated in a nitrogen-containing environment, or an oxynitriding treatment in which the iron alloy is heated in an oxygen- and nitrogen-containing environment. The thermochemical surface treatment may be performed by exposing the iron alloy to a gaseous and/or liquid environment, e.g., an oxygen- and/or nitrogen-containing gas or liquid. In some embodiments, during the thermochemical surface treatment, the iron alloy may be exposed to a nitrogen-containing environment and then subsequently exposed to an oxygen-containing environment, or vice versa. In some embodiments, the iron alloy may be exposed to an oxygen-containing and/or a nitrogen-containing environment and then subsequently heated to form the chemical compound layer at and along the outer peripheral surface of the die casting tool. The iron alloy may be exposed to an oxygen-containing environment, for example, by heating the iron alloy in air or water vapor or by immersing the iron alloy in an oxygen-containing liquid. The iron alloy may be exposed to a nitrogen-containing environment, for example, by heating the iron alloy in the presence of ammonia ($NH_3$) gas or exposing the iron alloy to a nitrogen-containing liquid. In some embodiments, the iron alloy may be subjected to a liquid oxynitriding treatment by heating the iron alloy in a liquid salt bath comprising a cyanate (e.g., KCNO and/or NaCNO), chloride (e.g., KCl and/or NaCl), carbonate (e.g., $K_2CO_3$, $Na_2CO_3$, and/or $LiO_2CO_3$), or a combination thereof.

The thermochemical surface treatment may be performed such that oxygen atoms and/or nitrogen atoms diffuse into a layer of material disposed along the surface of the iron alloy and form metal nitrides, metal oxides, and/or metal oxynitrides with metal elements included in the composition of the iron alloy. As such, the chemical compound layer 52 may comprise a layer of the iron alloy that includes a relatively high concentration of metal nitrides, metal oxides, and/or metal oxynitrides, as compared to a bulk volume 56 of the iron alloy underlying the chemical compound layer 52. The metal nitride, metal oxide, and/or metal oxynitride layer formed during the thermochemical surface treatment may have a thickness extending from the surface of the die casting tool of greater than or equal to about 1 micrometer to less than or equal to about 15 micrometers.

Referring now to FIG. 5, in some embodiments, the thermochemical surface treatment may comprise an oxidizing surface treatment and may result in the formation of an oxide layer 152 at and along a surface 150 of the iron alloy. During the oxidizing surface treatment, the iron alloy may be heated in an oxygen-containing environment at a temperature of greater than or equal to about 350° C. to less than or equal to about 600° C. for greater than or equal to about 0.5 hours to less than or equal to about 15 hours.

The oxide layer 152 may comprise a relatively high concentration of metal oxides, as compared to a bulk volume 156 of the iron alloy underlying the oxide layer 152. For example, the oxide layer 152 may comprise a relatively high concentration of iron oxides, e.g., $Fe_2O_3$ and/or $Fe_3O_4$. The iron oxides may be present in the oxide layer 152 in an amount comprising, by mass, greater than or equal to about 90% of the oxide layer 152. The oxide layer 152 may have a thickness of greater than or equal to about 1 micrometer to less than or equal to about 15 micrometers. In some aspects, the oxide layer 152 may have a thickness of greater than or equal to about 1 micrometer to less than or equal to about 5 micrometers, or a thickness of about 2 micrometers. In other aspects, the oxide layer 152 may have a thickness of greater than or equal to about 2 micrometers to less than or equal to about 8 micrometers. In yet another aspect, the oxide layer 152 may have a thickness of greater than or equal to about 3 micrometers to less than or equal to about 15 micrometers. The desired thickness of the oxide layer 152 may depend upon the amount of $Fe_2O_3$ in the oxide layer 152. Without intending to be bound by theory, it is believed that, due to the relatively low density of $Fe_2O_3$, as compared to that of $Fe_3O_4$, it may be easier to exfoliate $Fe_2O_3$ from the surface of the oxide layer 152. Therefore, if $Fe_2O_3$ comprises, by mass, greater than or equal to about 50% of the oxide layer 152, it may be desirable for the thickness of the oxide layer 152 to be kept relatively small to avoid an undesirable amount of exfoliation. For example, if $Fe_2O_3$ comprises, by mass, greater than or equal to about 50% of the oxide layer 152, the oxide layer 152 preferably has a thickness of less than or equal to about 5 micrometers.

The oxide layer 152 may be substantially free of chromium oxide, silicon oxide, or a combination thereof. For example, the chromium oxide and/or silicon oxide may comprise, by mass, less than 0.1%, preferably less than 0.05%, and more preferably less than 0.01% of the oxide layer 152. Without intending to be bound by theory, it is believed that, because chromium and silicon are not intentionally included in the composition of the presently disclosed iron alloy, the oxide layer 152 formed at and along the surface of the die casting tool may be relatively thick and more readily formed, as compared to iron alloys that intentionally include alloying elements of chromium and/or silicon.

Referring now to FIG. 6, in some embodiments, the thermochemical surface treatment may comprise an oxynitriding surface treatment and may result in the formation of an oxide layer 252, a nitride layer 258, and a diffusion layer 260 at and along a surface 250 of the iron alloy. As shown in FIG. 6, the oxide layer 252 may extend along and define the surface 250 of the iron alloy. The nitride layer 258 may be an underlying layer and extend directly underneath the oxide layer 252 along the surface 250 of the iron alloy. The diffusion layer 260 may extend directly underneath the nitride layer 258 (and thus underneath the oxide layer 252) along the surface 250 of the iron alloy. The oxide layer 252, the nitride layer 258, and the diffusion layer 260 may be formed at and along the surface 250 of the iron alloy by subjecting the surface 250 of the iron alloy to a nitriding surface treatment followed by an oxidizing surface treatment, or by subjecting the surface 250 of the iron alloy to an oxynitriding surface treatment in which the iron alloy is subjected to both an oxidizing and nitriding surface treatment at substantially the same time. For example, during the oxynitriding surface treatment, the iron alloy may be heated in a nitrogen-containing environment at a temperature of greater than or equal to about 400° C. to less than or equal to about 580° C. for greater than or equal to about 0.5 hours to less than or equal to about 15 hours, and then the iron alloy may be heated in an oxygen-containing environment at a temperature of greater than or equal to about 350° C. to less than or equal to about 600° C. for greater than or equal to about 0.1 hours to less than or equal to about 12 hours. As another example, the oxynitriding surface treatment may comprise a liquid oxynitriding surface treatment. During the liquid oxynitriding surface treatment, the iron alloy may be heated in an oxygen- and nitrogen-containing liquid salt bath at a temperature of greater than or equal to about 400° C. to less than or equal to about 580° C. for greater than or equal to about 0.5 hours to less than or equal to about 15 hours.

The oxide layer 252 may comprise a relatively high concentration of metal oxides, as compared to a bulk volume 256 of the iron alloy underlying the diffusion layer 260. For example, the oxide layer 252 may comprise a relatively high concentration of iron oxides, e.g., $Fe_2O_3$ and/or $Fe_3O_4$. The iron oxides may be present in the oxide layer 252 in an amount comprising, by mass, greater than or equal to about 5%, about 50%, or about 90% of the oxide layer 252. Like the oxide layer 152, the oxide layer 252 may be substantially free of chromium oxide and/or silicon oxide. The oxide layer 252 may have substantially the same thickness as that of the oxide layer 152. In the oxynitriding surface treatment, because the iron alloy is subjected to an oxidizing surface treatment after or at the same time as the iron alloy is subjected to a nitriding surface treatment, the oxide layer 252 may comprise a relatively high concentration of iron nitrides and aluminum nitrides, as compared to the concentration of iron nitrides and aluminum nitride in the bulk volume 256 of the iron alloy underlying the diffusion layer 260.

The nitride layer 258 may comprise a relatively high concentration of iron nitrides (e.g., $Fe_2N$, $Fe_3N$, and/or $Fe_4N$) and aluminum nitride (AlN), as compared to the concentration of iron nitrides and aluminum nitride in the bulk volume 256 of the iron alloy underlying the diffusion layer 260. The iron nitrides may be present in the nitride layer 258 in an amount comprising, by mass, greater than or equal to about 80% or about 90% of the nitride layer 258. The aluminum nitride may be present in the nitride layer 258 in an amount comprising, by mass, greater than or equal to about 0.5% to less than or equal to about 2.5% of the nitride layer 258. The nitride layer 258 may have a thickness of greater than or equal to about 2 micrometers to less than or equal to about 15 micrometers. Without intending to be bound by theory, it is believed that formation of aluminum nitride within the nitride layer 258 may substantially increase the hardness of the iron alloy, as compared to nitride layers formed on iron alloys that do not intentionally include aluminum as an alloying element.

The diffusion layer 260 may comprise a relatively high concentration of nitrogen, aluminum nitride (AlN) precipitates, and iron nitride precipitates (e.g., $Fe_2N$, $Fe_3N$, and/or $Fe_4N$), as compared to the concentration in the bulk volume 256 of the iron alloy underlying the diffusion layer 260. The nitrogen may be present in the diffusion layer 260 in an amount comprising, by mass, greater than or equal to about 0.002% or about 2% to less than or equal to about 13% of the diffusion layer 260. The aluminum nitride precipitates may be present in the diffusion layer 260 in an amount comprising, by mass, greater than or equal to about 0.01%, about 0.03%, about 0.1%, or about 0.3% to less than or equal to about 2.5% or about 1.5% of the diffusion layer 260. The iron nitride precipitates may be present in the diffusion layer 260 in an amount comprising, by mass, greater than or equal to about 0.01% or about 0.1% of the diffusion layer 260. The amount of nitrogen, aluminum nitride precipitates, and iron nitride precipitates in the diffusion layer 260 may gradually decrease from the nitride layer 258 toward the bulk volume 256 of the iron alloy. The diffusion layer 260 may have a thickness of greater than or equal to about 20 micrometers to less than or equal to about 150 micrometers. The thickness of the diffusion layer 260 may be determined by measuring the hardness of the iron alloy underlying the oxide layer 252 and the nitride layer 258, as will be known by persons having ordinary skill in the art. The addition of nitrogen and the formation of the aluminum nitride precipitates and the iron nitride precipitates may increase the hardness of the diffusion layer 260, as compared to the bulk volume 256 of the iron alloy underlying the diffusion layer 260. Regions of the iron alloy having a hardness of greater than or equal to about 105% of the bulk volume 256 of the iron alloy may be attributed to the diffusion layer 260.

Without intending to be bound by theory, it is believed that the metal oxide, metal nitride, and/or metal oxynitride layers formed on the surface of the die casting tool may help prevent or inhibit chemical reactions from occurring along an interface between the surface of the die casting tool and the nonferrous metal of the cast part during casting operations. As such, formation of the metal nitride, metal oxide, and/or metal oxynitride layer may help prevent or inhibit soldering between the die casting tool and the nonferrous metal of the cast part during the casting process. It has been found that, after the thermochemical surface treatment, the iron alloy may be substantially resistant to soldering when placed in direct contact with a volume of molten aluminum at a temperature in a range of about 600° C. to about 750° C.

EXAMPLES

Figure 7:
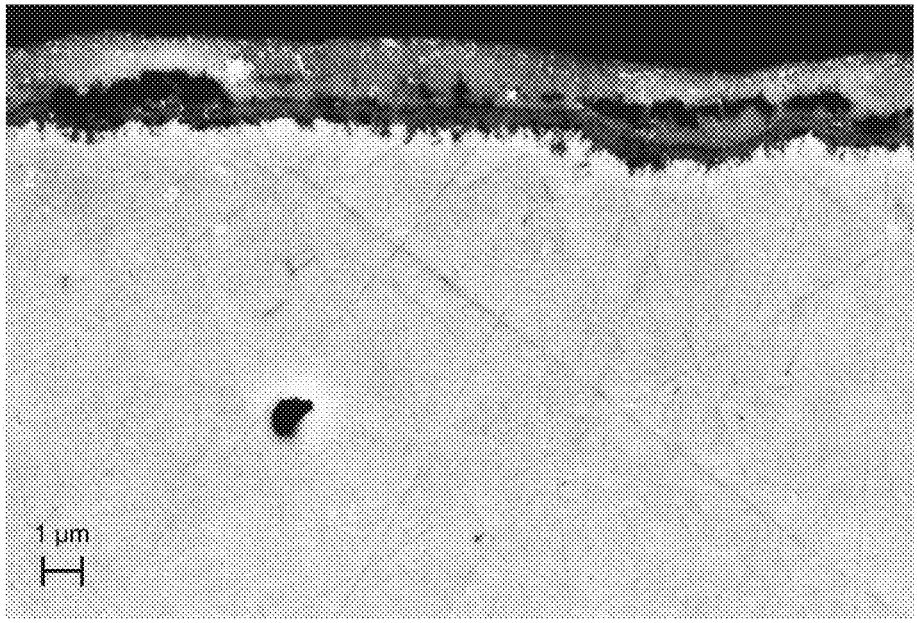
FIG. 7 is a scanning electron microscope (SEM) image of a surface of a die casting tool made of an Fe—Ni—Cu—Al—Mn—C alloy after the die casting tool has been subjected to an oxidizing treatment to form an oxide layer on the surface of the die casting tool.
Figure 8:
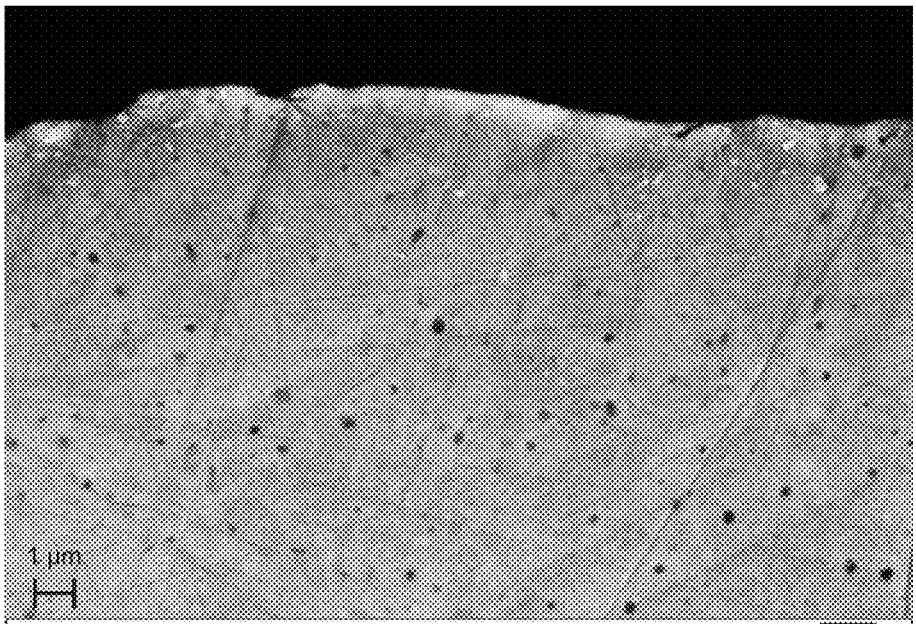
FIG. 8 is a scanning electron microscope (SEM) image of a surface of a die casting tool made of a commercially available H13 hot-work tool steel after the die casting tool has been subjected to an oxidizing treatment.

To evaluate the soldering resistance of the presently disclosed Fe—Ni—Cu—Al—Mn—C alloy, test pins of the Fe—Ni—Cu—Al—Mn—C alloy were prepared, subjected to a precipitation hardening heat treatment at a temperature of about 480° C. for a duration of about 12 hours, followed by an oxidizing treatment in air at a temperature of about 450° C. for a duration of about 8 hours. In addition, test pins made of a commercially available H13 hot-work tool steel were prepared and subjected to the same oxidizing heat treatment. As shown in FIG. 7, after subjecting the Fe—Ni—Cu—Al—Mn—C alloy to the oxidizing treatment, an oxide layer having a thickness of greater than about 2 micrometers is present on the surface of the Fe—Ni—Cu—Al—Mn—C alloy. Alternatively, as shown in FIG. 8, after subjecting the H13 hot-work tool steel to the oxidizing treatment, no discernable oxide layer forms on the surface of the H13 hot-work tool steel.

The test pins were immersed in a volume of molten aluminum having a temperature of about 705° C. for a duration of about 0.5 hours. The portion of the test pins that was immersed in the molten aluminum had a length of about 80 millimeters and a diameter of about 10 millimeters. After the test pins were removed from the molten aluminum, residual aluminum was washed therefrom. The test pins were dried and weighed to determine the weight loss of the pins resulting from their exposure to the molten aluminum. The test pins made of the presently disclosed iron alloy exhibited less than 0.1% weight loss. By contrast, test pins made of the commercially available H13 hot-work tool steel exhibited weight loss of about 2% to 3%. The tests results indicate that the presently disclosed iron alloy exhibits better soldering resistance than that of commercially available H13 hot-work tool steel.

The foregoing description of the embodiments has been provided for purposes of illustration and description. It is not intended to be exhaustive or to limit the disclosure. Individual elements or features of a particular embodiment are generally not limited to that embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A plunger for die casting, the plunger comprising:

a front injector end including a front wall, a cylindrical sidewall extending from the front wall, and an outer peripheral surface at least partially defined by a front face of the front wall and an outer circumferential surface of the cylindrical sidewall, the front injector end being made of an iron alloy comprising, by mass:

nickel in an amount greater than or equal to about 1% to less than or equal to about 6%;

copper in an amount greater than or equal to about 0.1% to less than or equal to about 5%;

aluminum in an amount greater than or equal to about 0.2% to less than or equal to about 2.5%;

manganese in an amount greater than or equal to about 0.5% to less than or equal to about 2%;

carbon in an amount greater than or equal to about 0.05% to less than or equal to about 0.2%; and greater than or equal to about 78% iron; and a chemical compound layer disposed at and along the outer peripheral surface of the front injector end, wherein the chemical compound layer comprises a relatively high concentration of at least one of metal oxides, metal nitrides, and metal oxynitrides, as compared to a bulk volume of the front injector end, wherein the chemical compound layer has a thickness extending from the outer peripheral surface of the front injector end of greater than or equal to about 2 micrometers to less than or equal to about 15 micrometers.

2. The plunger of claim 1, wherein the chemical compound layer comprises an oxide layer disposed at and along the outer peripheral surface of the front injector end, wherein the oxide layer comprises, by mass, $Fe_2O_3$ and/or $Fe_3O_4$ in an amount greater than or equal to about 90% of the oxide layer, and wherein the oxide layer has a thickness of greater than or equal to about 2 micrometers to less than or equal to about 15 micrometers.

3. The plunger of claim 2, wherein the oxide layer comprises, by mass, chromium oxide and/or silicon oxide in an amount less than or equal to about 0.1% of the oxide layer.

4. The plunger of claim 1, wherein the chemical compound layer comprises an oxide layer and a nitride layer extending underneath the oxide layer at and along the outer peripheral surface of the front injector end, wherein the oxide layer comprises, by mass, $Fe_2O_3$ and/or $Fe_3O_4$ in an amount greater than or equal to about 5% of the oxide layer, and wherein the nitride layer comprises, by mass, iron nitride in an amount greater than or equal to about 90% of the nitride layer and aluminum nitride in an amount greater than or equal to about 0.5% to less than or equal to about 2.5% of the nitride layer.

5. The plunger of claim 4, further comprising:

a diffusion layer extending underneath the nitride layer at and along the outer peripheral surface of the front injector end, wherein the diffusion layer comprises, by mass, aluminum nitride in an amount greater than or equal to about 0.01% to less than or equal to about 2.5% of the diffusion layer and iron nitride in an amount greater than or equal to about 0.01% of the diffusion layer.

6. The plunger of claim 1, wherein the iron alloy has a microstructure that comprises an iron-based matrix phase and an intermetallic precipitate phase distributed throughout the iron-based matrix phase, and wherein the iron-based matrix phase comprises at least one of martensite, bainite, and ferrite, and wherein the iron-based matrix phase comprises, by volume, less than 5% austenite.

7. The plunger of claim 6, wherein the intermetallic precipitate phase comprises intermetallic nanoparticles having a mean particle diameter of less than or equal to about 50 nanometers, and wherein each of the intermetallic nanoparticles comprises nickel, aluminum, copper, or a combination thereof.

8. The plunger of claim 7, wherein a distribution density of the intermetallic nanoparticles in the iron-based matrix phase is greater than or equal to about $10^{24}$ intermetallic nanoparticles per cubic meter.

9. The plunger of claim 7, wherein the microstructure of the iron alloy further comprises a metal carbide precipitate phase distributed throughout the iron-based matrix phase, and wherein the metal carbide precipitate phase comprises metal carbide particles having particle diameters less than about 250 nanometers.

10. The plunger of claim 1, wherein the iron alloy exhibits a Rockwell hardness of greater than or equal to about 42 HRC at a temperature of about 25° C., and wherein the iron alloy exhibits a thermal conductivity of greater than or equal to about 35 W/m·K at a temperature of greater than or equal to about 200° C. to less than or equal to about 500° C.

11. A method of manufacturing a plunger for die casting, the method comprising the following steps in the sequence set forth:

(i) forming an iron alloy into an initial shape of a front injector end of a plunger for a die casting machine, the iron alloy comprising, by mass:

nickel in an amount greater than or equal to about 1% to less than or equal to about 6%;

copper in an amount greater than or equal to about 0.1% to less than or equal to about 5%;

aluminum in an amount greater than or equal to about 0.2% to less than or equal to about 2.5%;

manganese in an amount greater than or equal to about 0.5% to less than or equal to about 2%;

carbon in an amount greater than or equal to about 0.05% to less than or equal to about 0.2%; and greater than or equal to about 78% iron;

(ii) heating the iron alloy to a temperature greater than or equal to about 900° C. to form a solid solution of iron and dissolved alloying elements;

(iii) cooling the iron alloy at a cooling rate of greater than or equal to about 5° C. per second to form a supersaturated solid solution of iron and dissolved alloying elements;

(iv) heating the iron alloy at a temperature sufficient to precipitate intermetallic nanoparticles from the supersaturated solid solution and form an intermetallic precipitate phase dispersed throughout an iron-based matrix phase; and (v) exposing the iron alloy to an oxygen-containing environment and/or a nitrogen-containing environment to form a chemical compound layer disposed at and along an outer peripheral surface of the front injector end, wherein the chemical compound layer comprises a relatively high concentration of at least one of metal oxides, metal nitrides, and metal oxynitrides, as compared to a bulk volume of the front injector end, wherein steps (iv) and (v) are performed substantially simultaneously.

12. The method of claim 11, wherein the iron alloy is heated in steps (iv) and (v) at a temperature of greater than or equal to about 350° C. to less than or equal to about 600° C.

13. The method of claim 12, wherein the iron alloy is exposed to an oxygen-containing environment in step (v) to form an oxide layer at and along the outer peripheral surface of the front injector end, wherein the oxide layer comprises, by mass, $Fe_2O_3$ and/or $Fe_3O_4$ in an amount greater than or equal to about 90% of the oxide layer, and wherein the oxide layer has a thickness of greater than or equal to about 2 micrometers to less than or equal to about 15 micrometers.

14. The method of claim 12, wherein the iron alloy is exposed to an oxygen-containing environment and a nitrogen-containing environment in step (v) to form an oxide layer, a nitride layer extending underneath the oxide layer, and a diffusion layer extending underneath the nitride layer along the outer peripheral surface of the front injector end, wherein the oxide layer comprises, by mass, $Fe_2O_3$ and/or $Fe_3O_4$ in an amount greater than or equal to about 5% of the oxide layer, and wherein the nitride layer comprises, by mass, iron nitride in an amount greater than or equal to about 90% of the nitride layer and aluminum nitride in an amount greater than or equal to about 0.5% to less than or equal to about 2.5% of the nitride layer.

15. The method of claim 14, wherein the iron alloy is exposed to the nitrogen-containing environment and then subsequently exposed to the oxygen-containing environment in step (v).

16. The method of claim 14, wherein the iron alloy is simultaneously exposed to the oxygen-containing environment and the nitrogen-containing environment in step (v).

17. The method of claim 16, wherein the iron alloy is simultaneously exposed to the oxygen-containing environment and the nitrogen-containing environment in step (v) by immersing the iron alloy in a liquid salt bath.

18. The method of claim 11, wherein, after step (iii) and prior to step (iv), the iron alloy has a Rockwell hardness of less than or equal to about 38 HRC at a temperature of about 25° C., and wherein, after step (iv), the iron alloy has a Rockwell hardness of greater than or equal to about 42 HRC at a temperature of about 25° C. and a thermal conductivity of greater than or equal to about 35 W/m·K at a temperature of greater than or equal to about 200° C. to less than or equal to about 500° C.

19. The method of claim 11, further comprising, after step (iii) and prior to step (iv):

machining the iron alloy to a final shape of the front injector end.

20. The method of claim 11, wherein the iron alloy is not subjected to an annealing heat treatment or a stress relief heat treatment prior to step (ii), and wherein the iron alloy is not subjected to a tempering heat treatment after step (iii).

* * * * *